US006860333B2

(12) United States Patent
Laib et al.

(10) Patent No.: US 6,860,333 B2
(45) Date of Patent: Mar. 1, 2005

(54) THERMALLY ACTIVATED FIRE SUPPRESSION SYSTEM

(75) Inventors: Trevor M. Laib, Woodinville, WA (US); David P. Ashby, Mukilteo, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/402,552

(22) Filed: Mar. 28, 2003

(65) Prior Publication Data

US 2004/0188103 A1 Sep. 30, 2004

(51) Int. Cl.[7] ..... A62C 2/00
(52) U.S. Cl. ..... 169/46; 169/58
(58) Field of Search ..... 169/9, 16, 17, 169/58, 46, 26, 62; 239/303, 304

(56) References Cited

U.S. PATENT DOCUMENTS 4,531,588 A * 7/1985 Brunsicke ..... 169/9
4,643,260 A * 2/1987 Miller ..... 169/46
4,726,426 A * 2/1988 Miller ..... 169/62
4,981,178 A * 1/1991 Bundy ..... 169/9
5,402,967 A * 4/1995 Hughes ..... 244/129.2
5,632,338 A * 5/1997 Hunter ..... 169/9
6,263,974 B1 * 7/2001 Sundholm ..... 169/62
6,390,203 B1 * 5/2002 Borisov et al. ..... 169/62
6,415,870 B1 * 7/2002 Matsuoka ..... 169/16

* cited by examiner

*Primary Examiner*—David A. Scherbel
*Assistant Examiner*—Thach H. Bui
(74) *Attorney, Agent, or Firm*—Black Lowe & Graham PLLC; Mark S. Beaufait

(57) ABSTRACT

The present invention provides a system for releasing material. The system includes a container arranged to hold a material to be released. The container has a first seal and a second seal that are arranged to open when a release is desired. Piping is configured to release the material and the piping has at least one tube connected to the reservoir through the first seal. A pressure source is connected to the reservoir through the second seal. A pressure release is configured to release pressure from the piping when release of the material is desired. The seals may include burst disks that open upon a release of pressure in the piping. Materials that can be released by the system include fire suppressant materials.

26 Claims, 3 Drawing Sheets

THERMALLY ACTIVATED FIRE SUPPRESSION SYSTEM

FIELD OF THE INVENTION

This invention relates generally to material release systems, and, more specifically, to fire suppression systems.

BACKGROUND OF THE INVENTION

Systems for the release of materials in selected locations, such as fire sprinkler systems, are often large, cumbersome, and not designed to be cycled numerous times from being pressurized to non-pressurized. Material delivery systems, such as sprinklers, where the delivery piping is charged with the material to be dispersed, are more difficult to maintain than systems where the piping is not charged. This is because the material must be drained from the piping during maintenance and recharging.

In aircraft, for example, it may be desired to release fire suppressant material in hidden or difficult-to-access areas in the event of a fire. The varying temperatures and pressures to which such a system is exposed combined with the desire to reliably and repeatedly maintain the system makes a system without piping charged with the fire suppression material more convenient. Further, systems that do not have sealed containers for the material to be released are more difficult to charge and recharge. However, current delivery systems do not include sealed material containers which can be readily pressurized and depressurized and replaced in the system for maintenance, or in the event of an upgrade.

Material delivery systems such as fire sprinklers often involve larger piping and wide-area sprinklers. Such systems are not readily used, nor necessary for, smaller hidden and inaccessible areas. Therefore, there exists an unmet need for lightweight and simple to install and maintain systems to disburse materials, such as fire suppressant materials, in specific directed locations, including, but not limited to, hidden and difficult to access areas in aircraft.

SUMMARY OF THE INVENTION

The present invention presents a system for dispersing materials at directed locations. The invention retains the material to be released in a sealed reservoir. The piping for the system is not charged with the material to be released unless an actual release occurs.

An embodiment of the present invention presents a system for releasing material. The system includes a reservoir arranged to hold a material to be released. The reservoir has a first seal and a second seal. The first seal and the second seal are arranged to open when a release is desired. The system includes piping configured to release the material and the piping has at least one tube connected to the reservoir through the first seal. A pressure source is connected to the reservoir through the second seal. A pressure release is configured to release pressure from the piping when release of the material is desired.

In accordance with further aspects of the invention, the seals may include burst disks that open upon a release of pressure in the piping. Materials that can be released by the system include fire suppressant materials. In further aspects of the invention, the pressure release for the system may include melt-out nozzles, frangible tubing, combustible tubing, and meltable tubing.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, an embodiment of the present invention presents a system for dispersing materials at directed locations. The system includes a reservoir arranged to hold a material to be released. The reservoir has a first seal and a second seal. The first seal and the second seal are arranged to open when a release is desired. The system includes piping configured to release the material and the piping has at least one tube connected to the reservoir through the first seal. A pressure source is connected to the reservoir through the second seal. A pressure release is configured to release pressure from the piping when release of the material is desired. The seals may include burst disks that open upon a release of pressure in the piping. Materials that can be released by the system include fire suppressant materials, and the pressure release for the system may include melt-out nozzles, frangible tubing, combustible tubing, and meltable tubing.

Figure 1:
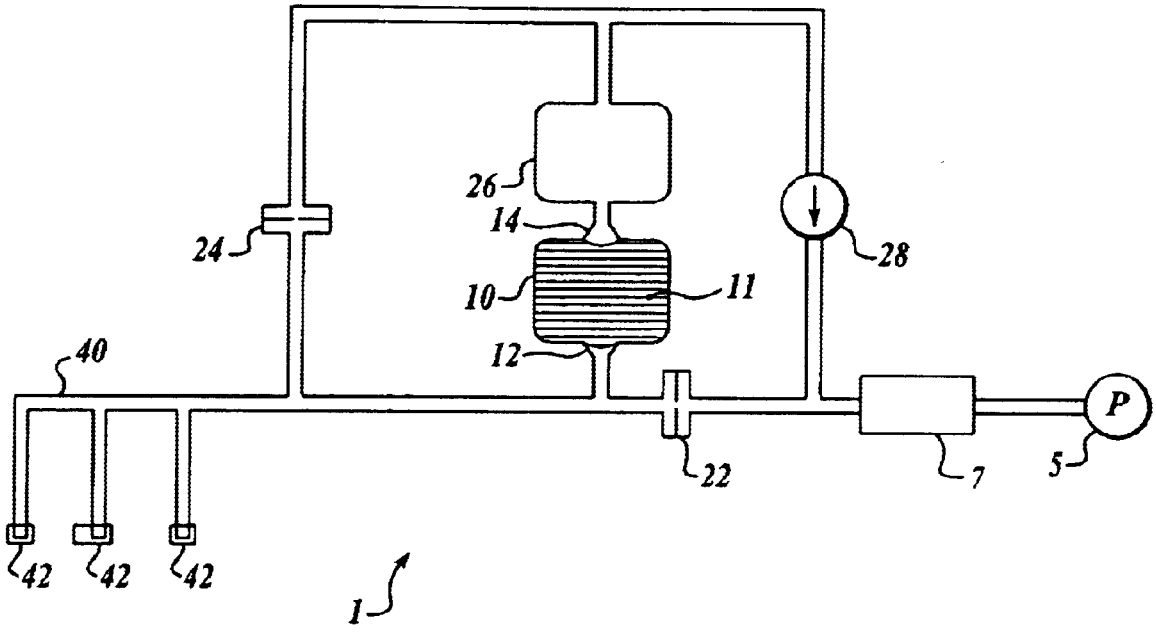
FIG. 1 is a diagram of an exemplary fire suppression system of the present invention.

FIG. 1 is a diagram of a fire suppression system 1 implementing the present invention. The system 1 is suitably implemented using a pressure source 5 which provides pressure to the system through a filter 7. It will be appreciated that any suitable pressure source may be utilized by the present invention, including by way of example but not limitation, stored compressed gas, gas generation systems, compressors, or in turbine powered vehicles, bleed air pressure. In aircraft, bleed air pressure from the engines is an advantageous pressure source.

In the system 1, pressure is applied to a network of piping 40 through an orifice 22. The orifice 22 limits the rate at which the piping 40 is pressurized. The orifice 22 also limits repressurization of the piping 40 from the pressure source 5 in the event of a discharge, and slows depressurization of the piping 40 when the system 1 is depressurized or disarmed by reducing the pressure from the pressure source 5. The orifice 22 thus limits the rate of pressure equalization between the piping 40 and the pressure source 5. The piping 40 is connected to at least one temperature activated nozzle, in this embodiment, by way of example and not limitation, melt-out nozzles 42. The melt-out nozzles 42 are placed in a location where fire protection by the system 1 is desired. Melt-out nozzles 42 open at a specified temperature, and include low melting point solder filled tubing or tabs that open when exposed to a specified temperature. The piping 40 and the melt-out nozzles 42 advantageously may be made small and moldable to be installed individually or in a network thereby providing fire protection to suitable locations in small or otherwise unaccessible areas. For example, a network of flexible tubing with multiple melt-out nozzles 42 may provide fire protection to areas behind paneling and other systems on aircraft. The piping 40 is also connected to a pressure reserve reservoir or discharge reserve 26 such as a bottle or other container, which provides pressure to the reservoir 10 holding the fire suppressant material 11. Pressure from the network 40 that is applied to the discharge reserve 26 passes through and is controlled by a pressure orifice 24. As pressure is applied from the piping 40 to the reservoir 10 through the pressure orifice 24, the pressure applied to the reservoir 10, is less than or equal to pressure in the piping 40 absent a discharge event as described further below. The pressure orifice 24 thus slows the rate of pressure equalization between the piping 40 and the reservoir 10. The discharge reserve 26 suitably may be of any size to pressurize the reservoir 10 and force the fire suppressant material 11 out through the piping 40 in the event of a discharge. It will be appreciated that a discharge reserve 26 may be omitted. This depends on the type and configuration of the pressure source 5, so long as sufficient pressure is available to force the discharge of the fire suppressant material 11 from the reservoir 10 through the network piping 40 out through a melt-out nozzle 42 that has been opened by a fire.

The reservoir 10 is also directly connected to the piping 40 through a release burst disk 12. The release burst disk 12 bursts or ruptures in the event of a pressure loss in the piping 40 which occurs when a fire suppressant material discharge is required. The reservoir 10 is also sealed at its connection with the discharge reserve 26 by a pressure burst disk 14. The pressure burst disk 14 similarly bursts when pressure in the piping 40 drops, and the release burst disk 12 bursts. The reservoir 10 thus is sealed where pressure is applied by the discharge reserve 26 through the pressure burst disk 14, and is sealed by the release burst disk 12 where the reservoir 10 is connected to the piping 40. It will be appreciated that any suitable method of sealing or closing the reservoir 10 from the pressure source 5 and the piping 40, and providing for release of the fire suppressant material 11, may be utilized in place of burst disks. As is known, burst disks, also known as rupture disks, are designed to burst at a predetermined pressure differential between their sides, often in a single direction. In this embodiment, the release burst disk 12 and the pressure burst disk 14 burst when pressure in the piping 40 decreases. This occurs when a melt-out nozzle 42 melts out as a result of fire, and results in discharge of the fire suppressant material 11. The release burst disk 12 and the pressure burst disk 14 open when pressure in the piping 40 drops, but do not open in response to backpressure from the piping 40.

The release burst disk 12 and pressure burst disk 14 also act as seals or closures for the reservoir 10. With the reservoir 10 sealed by the bursts disks 12 and 14, with suitable connections to the system 1, the reservoir 10 may be detached from the system 1 and replaced as needed. Suitable seals or closures for the reservoir 10, by way of example and not limitation, may also include electrically actuated valves or squibs with seals. As is known, squibs are small explosive devices similar to a detonator which initiate a pressure pulse that bursts the accompanying seal. Such suitable closures or seals permit the reservoir 10 to be detachable from the system 1 without any release of the fire suppressant material 11. It will be appreciated that burst disks are suitably advantageous because they are passive devices. It will be further appreciated that the reservoir 10 may be any suitable container or enclosure, including a bladder or other container. Sizing the reservoir 10 to match the area to be protected from fire can suitably release limited and safe amounts of fire suppressant in occupied areas, while still providing appropriate fire protection.

The system 1 also includes a check valve 28 connected between the discharge reserve 26 and the pressure source 5. The check valve 28 acts as a one way valve and releases pressure from the discharge reserve 26 when the system is disarmed by reducing the pressure from the pressure source 5. The check valve 28 permits the pressure applied to the discharge reserve 26, and hence to the reservoir 10, to fall more rapidly than pressure in the piping 40 when the pressure from the pressure source 5 is released or reduced. The orifice 22 slows the release of pressure from the piping 40 when the pressure from pressure source 5 is reduced. Thus, when the pressure source 5 is disconnected or released, pressure in the piping 40 remains higher than the pressure applied to the reservoir 10. As noted above, the release burst disk 12 connected to the reservoir 10 opens only if the pressure in the piping 40 reduces significantly below that applied to the reservoir 10. The release burst disk 12 thus remains intact during an intended non-release depressurization, thereby allowing the system 1 to be disarmed without any release of suppressant material. In aircraft, the pressure source 5 may bleed air from jet turbine engines. In such an embodiment, the pressure to the system 1 would be released when the engines are shut off, thereby disarming the system. In such an embodiment, the system would automatically be disarmed when the aircraft is on the ground with engines not running.

In the event of a fire, the melt-out nozzles 42 open and pressure drops in the piping 40. The pressure applied by the pressure reservoir 26 through the pressure burst disk 14 to the fire suppressant material 11 in the reservoir 10 exceeds the pressure in the piping 40 (which has decreased towards ambient pressure when the melt-out nozzle 42 opens). The release burst disk 12 and the pressure burst disk 14 open and pressure from the reserve reservoir 26 forces fire suppressant material 11 into the piping 40 and out through open melt-out nozzles 42 in the area of the fire. The pressure orifice 24 limits pressure backflow or leakage into the piping 40 from the discharge reserve 26, other than through discharge of the fire suppressant material 11 from the reservoir 10. A check valve may suitably be used in the place of pressure orifice 24.

It will be appreciated that the system of the present invention can suitably utilize a wide variety of discharge nozzles or mechanisms, and may accommodate a wide variety of materials desired to be released in specific locations. For example, the piping 40 of the system suitably may be a laced network of meltable, combustible, or frangible piping. Such piping would suitably release thee desired material at a location where heat or fire occurs without the use of a meltout nozzle. Meltable tubing may be especially advantageous for release of fire suppressant materials, because fire protection would still be provided to areas that did not contain meltout nozzles.

Similarly, a frangible or breakable tube may release any desired material at a break in the piping network. Materials that may be released by the system of the present invention, by way of example and not limitation, include dyes, adhesives, or animal or insect poisons. For example, if the piping 40 were consumable by vermin or insects, the system could discharge a suitable poison, repellant, or insecticide at the location of the break. As a further example, if the piping 40 dissolves in the presence of moisture, a network of piping 40 could distribute a dye or a sealant to a location of water or moisture intrusion. Independent of the piping system utilized and the materials delivered, the piping network of the system of the present invention need not contain the material to be released, and the material itself would remain in the sealed container unless a discharge event occurred.

It will be appreciated that any suitable fire suppressant material may be utilized including, by way of example and not limitation, Halon, FE-22, and FM-200. It will be further appreciated that such fire suppressants can be effective in relatively low concentrations. The system 1 thus delivers suitable quantities of fire suppressant to small, confined, and otherwise inaccessible spaces through the placement of piping 40 and a melt-out nozzle 42 through or into such spaces.

Advantageously, the pressure applied to the reserve reservoir 26 and reservoir 10 need not be provided by the same pressure source 5 as the pressure applied to the piping 40. Similarly, suitable valves or the flow controls may be utilized with or in place of the network orifice 22 and the pressure orifice 24, to slow or limit pressure equalization to suitably provide that the pressure used to arm the system 1 by pressurizing the piping 40 is greater than or equal to the pressure applied to the reservoir 10, absent a discharge event. By way of example and not limitation, an interlocking set of valves or a pressure bias valve may provide for the piping 40 to be pressurized before the discharge reserve 26 during arming of the system 1. Conversely, the interlocking set of valves or pressure bias valve may provide that the pressure in the pressure reservoir 26 is reduced before pressure in the piping 40 is reduced when the system 1 is disarmed.

When the pressure from the pressure source 5 is removed, the piping 40 is empty. This permits maintenance operations without release of any fire suppressant material. Further, when pressure from the pressure source 5 is released, the reservoir 10 is sealed by the release burst disk 12 and the pressure burst disk 14. As a result, the reservoir 10 may be detached and removed from the system for maintenance or replacement. It will also be appreciated that the filter 7 for the pressure source may be of any suitable type, and may suitably be omitted depending upon whether the pressure source 5 may introduce contaminants into the system 1. For example, the filter 7 may be omitted if the pressure source 5 is clean bottled compressed gas.

Figure 2:
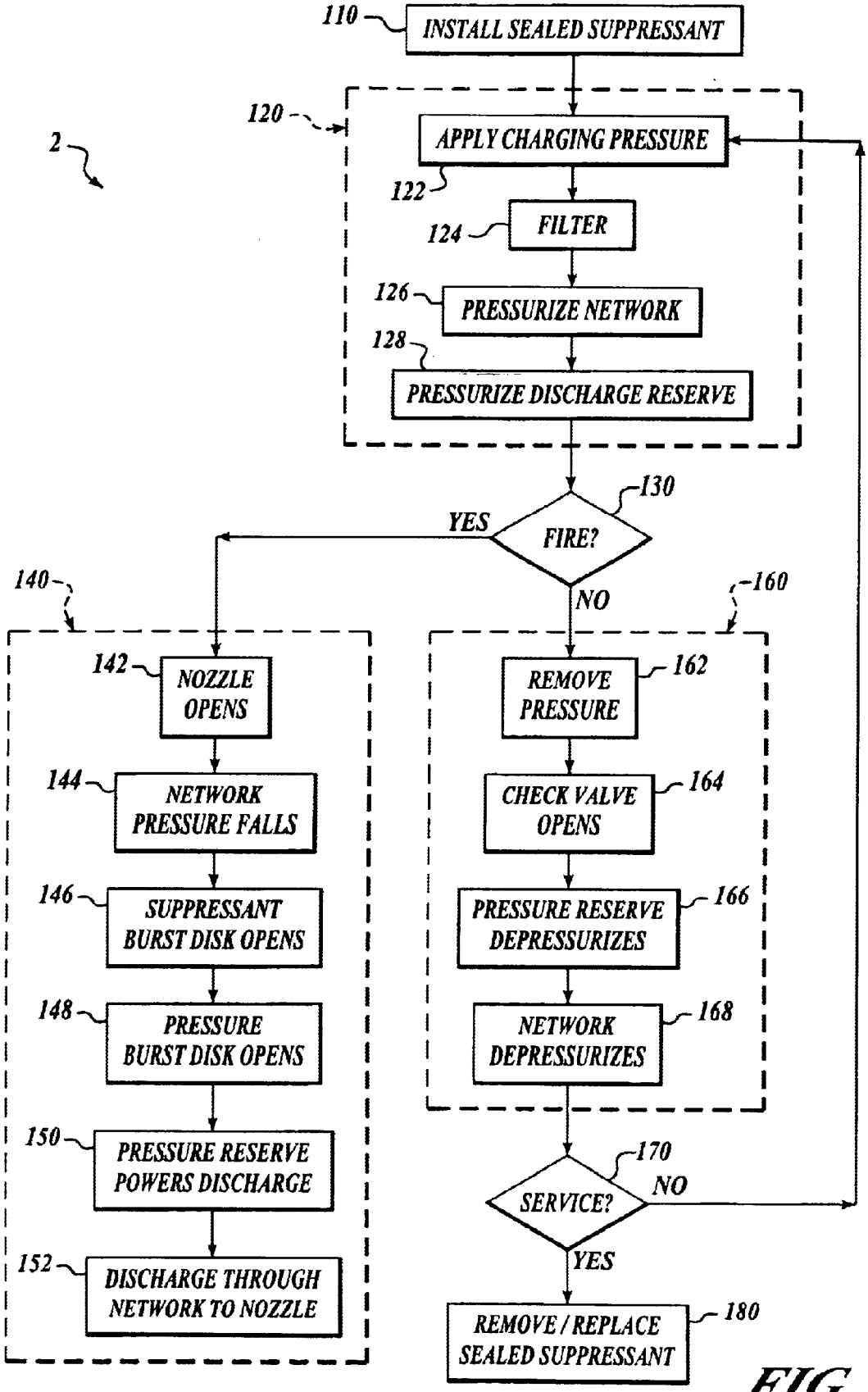
FIG. 2 is a flow chart of the operation of an exemplary fire suppression system of the present invention.

FIG. 2 is a flow chart of a routine 2 for operation of an example embodiment of a fire suppressant system. At a block 110 the fire suppressant is installed in its sealed container. The system is then armed through an arming sequence 120. The arming sequence 120 applies charging pressure at a block 122 and filters applied pressure at a block 124. The piping network is pressurized at a block 126. After the piping network has been pressurized, the discharge reserve or reserve reservoir is pressurized at a block 128. Pressurizing the discharge reserve at a block 128 after pressurizing the piping network at a block 126 maintains the pressure in the discharge network at a level greater than or equal to that of the discharge reserve. When the pressure in the network is greater than or equal to the pressure in the discharge reserve, the burst disks in the sealed suppressant container maintain their seals.

At a decision block 130, a determination is made whether fire is detected. In the event of a fire, the system proceeds through a discharge cycle at a block 140. If there is no fire, the system may be disarmed through a disarm cycle at a block 160.

The discharge cycle at the block 140 includes a block 142 where a melt-out nozzle in the area of the fire melts and opens, thereby reducing pressure in the piping network to ambient pressure. After the nozzle opens, network pressure decreases and pressure falls at a block 144. With falling network pressure, the suppressant burst disk between the suppressant container and the network opens at a block 146, and the pressure burst disk between the discharge reserve and the suppressant container opens at a block 148. The discharge reserve or pressure reserve then powers discharge of the fire suppressant material at a block 150. Driven by pressure from the pressure reserve, a discharge of the suppressant material occurs at the fire location at a block 152.

In the absence of a fire, the system may be cycled through its disarm cycle at the block 160. The disarm cycle at the block 160, includes a block 162 where pressure is released from the system or disconnected from the system. In the exemplary embodiment shown in FIG. 1, the check valve opens at a block 164. The opening check valve relieves pressure in the discharge reserve and at a block 166, the pressure reserve depressurizes. It will be appreciated that a check valve suitably may be omitted where means are provided for releasing pressure from the pressure reserve. After the pressure reserve depressurizes at the block 166, the piping network depressurizes at a block 168. In this routine, the pressure in the network is maintained higher than the pressure in the pressure reserve. This advantageously avoids inadvertent discharge of fire suppressant material.

After the system has gone through the disarm cycle at a block 160, a determination is made at a decision block 170 whether to service the system. If no service is to be performed, the system is ready to be repressurized and the process may be repeated again beginning at the block 122. If service is desired, the sealed suppressant may be removed or replaced at a block 180. It will be appreciated that the routine of FIG. 2 may be run through its charging cycle, block 120, and the disarm cycle, block 160, numerous times without releasing the fire suppressant material from its sealed container, and without releasing any fire suppressant material into the piping network.

Figure 3:
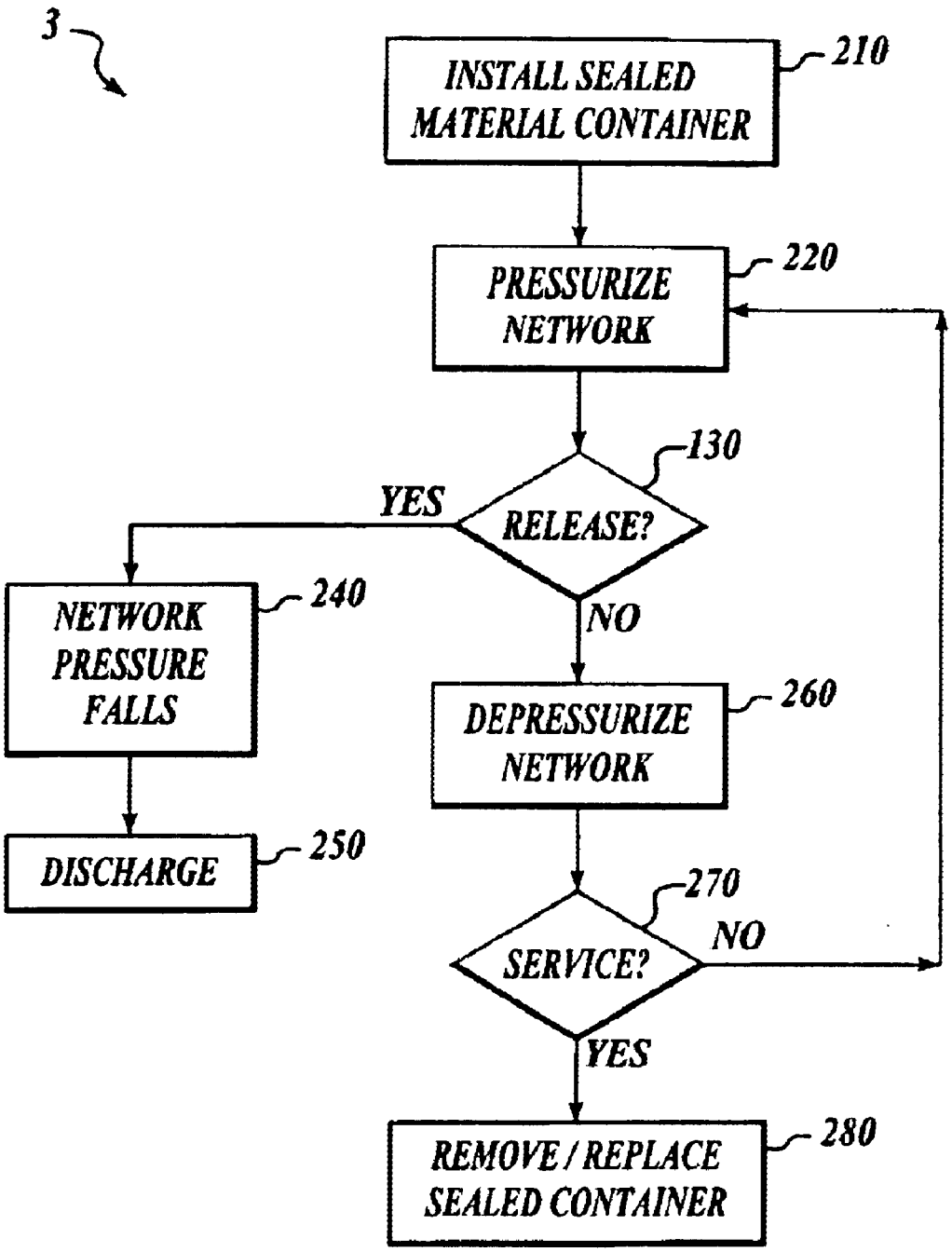
FIG. 3 is a flow chart of the operation of an exemplary material release system of the present invention.

FIG. 3 is a flow chart of a process 3 for discharging a variety of materials. At a block 210 the material desired to be released is installed in the system. At a block 220 the piping network is pressurized. At a decision block 130 a determination is made whether to release material. If a release condition occurs, pressure in the network falls at a block 240 followed by discharge at a block 250. If a release is not appropriate, the network is depressurized at a block 260. After the network is depressurized, a determination is made at a decision block 270 whether to service the system. If service is not desired, the system can be cycled again and repressurized at the block 220. If service is desired, the reservoir or sealed material container may be removed or replaced at a block 280. It will be appreciated that the material container remains sealed unless a discharge event occurs and that the discharge is triggered by conditions resulting in network pressure falling at the block 240. The process 3 can suitably discharge a wide range or type of materials through a wide range of piping networks.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A system for releasing material, the system comprising:

a first reservoir arranged to hold a material to be released, the reservoir having a first seal and a second seal, the first seal and the second seal arranged to open when a release of the material is desired;

piping configured to release the material, the piping having at least one tube connected to the first reservoir through the first seal;

at least one pressure source connected to the first reservoir through the second seal and connected to the piping, the at least one pressure source being arranged to provide a first pressure to the piping and the first reservoir;

a pressure release configured to reduce pressure from the piping when release of the material is desired.

2. The system of claim 1, wherein the material includes a fire suppressant material.

3. The system of claim 1, wherein the first seal and the second seal are arranged to open in response to a decrease in the pressure to the piping.

4. The system of claim 1, wherein the first seal includes a burst disk and the second seal includes a burst disk.

5. The system of claim 1, wherein the first seal includes a valve and the second seal includes a valve.

6. The system of claim 1, wherein the first seal includes a squib and the second seal includes a squib.

7. The system of claim 1, wherein the pressure release includes at least one temperature-activated nozzle.

8. The system of claim 1, wherein the piping includes meltable tubing.

9. The system of claim 1, wherein the piping includes one of frangible tubing, combustible tubing, dissolvable tubing, and consumable tubing.

10. The system of claim 1, further comprising:

a second reservoir connected to the first reservoir through the second seal and connected to the at least one pressure source, the second reservoir being arranged to provide a second pressure arranged to power a discharge when discharge of the material is desired.

11. A system for releasing fire suppressant material, the system comprising:

a container arranged to hold the fire suppressant material to be released, the container having a first burst disk and a second burst disk;

piping configured to release the fire suppressant, the piping having at least one tube connected to the container through the first burst disk, the first burst disk being arranged to burst when a first pressure in the piping is less than a second pressure in the container;

a reservoir connected to the container through the second burst disk, the second burst disk being arranged to burst when the second pressure in the container is less than a third pressure in the reservoir, the third pressure being arranged to power a discharge of the fire suppressant material;

a pressure source connected to the piping, the pressure source being arranged to provide the first pressure to the piping; and at least one nozzle connected to the piping, the at least one nozzle being arranged to open in the presence of a fire reducing the first pressure in the piping, the at least one nozzle being further arranged to discharge the fire suppressant material from the container when the first pressure is less than the second pressure.

12. The system of claim 11, wherein the at least one nozzle includes at least one melt-out nozzle.

13. The system of claim 11, further comprising:

a first orifice connected between the pressure source and the piping, the first orifice being arranged to reduce a first rate of pressure equalization between the piping and the pressure source.

14. The system of claim 11, wherein the reservoir is connected to the piping, thereby connecting the reservoir to the pressure source, the pressure source being arranged to provide the third pressure to the reservoir.

15. The system of claim 14, further comprising:

a second orifice connected between the reservoir and the piping, the second orifice being arranged to reduce a second rate of pressure equalization between the piping and the reservoir.

16. The system of claim 14, further comprising:

a check valve connected between the reservoir and the piping, the second orifice being arranged to reduce a second rate of pressure equalization between the piping and the reservoir.

17. The system of claim 11, further comprising:

a check valve connected to the reservoir, the check valve being arranged to reduce the third pressure when the first pressure provided by the pressure source is reduced to disarm the system.

18. A method for releasing material, the method comprising:

sealing a material in a container with at least one seal;

pressurizing piping that is connected to the container both upstream of the container and downstream of the container;

depressurizing the downstream piping when a release of the material is desired;

opening the at least one seal when the downstream piping network is depressurized, thereby releasing the material through the at least one seal into the piping; and disarming by depressurizing the piping network and depressurizing the container without opening the at least one seal.

19. A method for releasing material, the method comprising:

sealing a material in a container with at least one seal;

pressurizing piping that is connected to the container both upstream of the container and downstream of the container;

depressurizing the downstream piping when a release of the material is desired;

opening the at least one seal when the downstream piping network is depressurized, thereby releasing the material through the at least one seal into the piping; and servicing by removing the container.

20. A method for releasing material, the method comprising:

sealing a material in a container with at least one seal, wherein the at least one seal includes a first burst disk and a second burst disk;

pressurizing piping that is connected to the container both upstream of the container and downstream of the container;

depressurizing the downstream piping when a release of the material is desired; and opening the at least one seal when the downstream piping network is depressurized, thereby releasing the material through the at least one seal into the piping.

21. A method for releasing fire suppressant, the method comprising:

sealing fire suppressant in a container with a first burst disk and a second burst disk;

connecting the container to piping through the first burst disk, the first burst disk being arranged to burst when a first pressure in the piping network is less than a second pressure in the container;

connecting the container to a reservoir through the second burst disk, the second burst disk being arranged to burst when the second pressure in the container is less than a third pressure in the reservoir;

pressurizing the piping from a pressure source to the first pressure;

pressurizing the reservoir from the piping to the third pressure, the third pressure being less than or equal to the first pressure;

pressurizing the container to the second pressure, the second pressure being less than or equal to the first pressure;

depressurizing the piping through a melt-out nozzle if a fire occurs;

bursting the first burst disk and the second burst disk when the piping is depressurized by the fire;

releasing the fire suppressant from the container though the first burst disk into the piping; and releasing the fire suppressant from the piping through the melt-out nozzle.

22. The method of claim 21, further comprising servicing by removing the container.

23. The method of claim 21, wherein pressurizing the piping includes pressurizing the piping through a first orifice, the first orifice reducing a rate of pressure equalization between the piping and the pressure source.

24. The method of claim 21, wherein pressurizing the reservoir from the piping includes pressuring the reservoir through a second orifice, the second orifice reducing a rate of pressure equalization between the piping and the reservoir.

25. The method of claim 21, further comprising disarming by depressurizing the reservoir though a check valve.

26. The method of claim 25, wherein depressurizing the reservoir further includes depressurizing the piping network through the first orifice and depressurizing the reservoir through a check valve.

* * * * *